US007648425B2

(12) United States Patent
Wahl et al.

(10) Patent No.: US 7,648,425 B2
(45) Date of Patent: Jan. 19, 2010

(54) GOLF PUTTER HEAD

(75) Inventors: Bret H. Wahl, Escondido, CA (US); Marni Ines, San Marcos, CA (US); Robert Nunez, San Pedro, CA (US); Jose Miraflor, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 490 days.

(21) Appl. No.: 11/640,130

(22) Filed: Dec. 15, 2006

(65) Prior Publication Data

US 2008/0146369 A1 Jun. 19, 2008

(51) Int. Cl.
*A63B 53/04* (2006.01)

(52) U.S. Cl. ..... 473/334; 473/338; 473/340; 473/342; 473/349

(58) Field of Classification Search ..... 473/324–350, 473/251–256, 287–292; D21/736–746
See application file for complete search history.

(56) References Cited

U.S. PATENT DOCUMENTS

| | | | | | |
|---|---|---|---|---|---|
| D282,952 | S * | 3/1986 | Mattingly | D21/746 |
| 5,417,429 | A | 5/1995 | Strand | |
| 6,652,390 | B2 | 11/2003 | Bradford | |
| 6,716,110 | B1 * | 4/2004 | Ballow | 473/242 |
| 6,929,559 | B1 * | 8/2005 | Grace | 473/251 |
| 6,974,394 | B1 | 12/2005 | Tang et al. | |
| 6,988,959 | B2 * | 1/2006 | Pollman | 473/313 |
| 7,018,304 | B2 | 3/2006 | Bradford | |
| D520,584 | S * | 5/2006 | Karlsen | D21/743 |
| 7,048,639 | B2 | 5/2006 | Grace | |
| D540,897 | S * | 4/2007 | Oldknow et al. | D21/736 |
| D541,361 | S * | 4/2007 | Oldknow | D21/759 |
| D541,362 | S * | 4/2007 | Oldknow | D21/759 |
| D542,871 | S * | 5/2007 | Oldknow | D21/759 |
| D542,872 | S * | 5/2007 | Oldknow | D21/759 |
| D542,873 | S * | 5/2007 | Oldknow | D21/759 |
| 7,244,191 | B2 * | 7/2007 | Tang et al. | 473/335 |
| D569,460 | S * | 5/2008 | Walker | D21/743 |
| 7,407,443 | B2 * | 8/2008 | Franklin et al. | 473/251 |
| 7,438,648 | B2 * | 10/2008 | Wahl et al. | 473/340 |
| D584,780 | S * | 1/2009 | Ines et al. | D21/746 |
| 2008/0153623 | A1 * | 6/2008 | Ines | 473/340 |
| 2008/0161127 | A1 * | 7/2008 | Yamamoto | 473/350 |

OTHER PUBLICATIONS

Nike Black OZ T130 Putter, http://www.nike.cm/nikegolf/flash_reg.jhtml.

Nike Black OZ T130 Putter, http://www.nike.com/nikegolf/flash_reg.jhtml.

Unitized Techno Putter, http://www.nike.com/nikegolf/flash_reg.jhtml.

Unitized Techno Putter, http://www.nike.com/nikegolf/flash_reg.jhtml.

Fourteen, BR-II Head Specifications, http://www.fourteengolf.com/product/putter/br-3/index,html.

(Continued)

*Primary Examiner*—Sebastiano Passaniti
(74) *Attorney, Agent, or Firm*—Klarquist Sparkman, LLP

(57) ABSTRACT

A high inertia golf putter head is generally wedge-shaped, with the leading face being less wide than the trailing face. Cavities and weights are provided to optimize the moment of inertia.

7 Claims, 3 Drawing Sheets

OTHER PUBLICATIONS

Never Compromise CM2 Exchange 1, http://www.nevercompromise.com/nevercompromise.html.
Never Compromise GM2 Exchange 1, http://www.nevercompromise.com/nevercompromise.html (top view).
Never Compromise GM2 Exchange 1, http://www.nevercompromise.com/nevercompromise.html (bottom view).
Never Compromise GM2 Exchange 2, http://www.nevercompromise.com/nevercompromise.html (side view).
Never Compromise GM2 Exchange 2, http://www.nevercompromise.com/nevercompromise.html (top angle).
Never Compromise GM2 Exchange 3, http://nevercompromise.com/nevercompromise.html (side view).
Never Compromise GM2 Exchange 3, http://nevercompromise.com/nevercompromise.html.
Never Compromise GM2 Exchange 3, http://nevercompromise.com/nevercompromise.html (bottom view).

* cited by examiner

GOLF PUTTER HEAD

I. FIELD OF THE INVENTION

The present invention relates generally to golf putter heads.

II. BACKGROUND OF THE INVENTION

In a perfect putt, the golfer strikes the ball exactly on the sweet spot of the putter head. This prevents the putter head from twisting about the axis defined by the golf club shaft, which otherwise leads to poorly aligned putts, because when the sweet spot is missed, the inertia of the ball imparts a torque to the golf club shaft. The torque increases in proportion to the distance by which the sweet spot is missed.

Accordingly, putter heads having high moments of inertia to resist the torque caused by missing the sweet spot have been provided. Putter heads having high moments of inertia may be relatively wide and may have weights placed at various locations to improve performance. An example of such a head is set forth in U.S. Pat. No. 7,048,639, in which a large triangular head has a leading face that is greater in breadth than the trailing face. An example of a putter with weights is disclosed in U.S. Pat. No. 6,974,394. As recognized herein, additional improvements in terms of moment of inertia and/or sweet spot strike guiding can be provided.

SUMMARY OF THE INVENTION

A golf putter head is provided with a high moment of inertia (MOI) about the vertical axis through the head's center of gravity and also about the heel-to-toe axis through the center of gravity for stability. This is achieved by a hollow design in which most of the mass of the head is disposed rearwardly on the head and is spaced laterally from the swing axis.

Accordingly, a golf putter head includes a generally wedge shaped unitary body defining a leading portion for striking a golf ball and a trailing portion. The width of the leading portion in the heel-to-toe dimension of the head is less than the width of the trailing portion. The trailing portion includes a trailing edge that extends substantially completely across the second width and that is straight or gently convex.

In non-limiting implementations the body defines a toe wall that connects a toe edge of the leading portion with a toe edge of the trailing portion and a heel wall that connects a heel edge of the leading portion with a heel edge of the trailing portion. The leading portion, the trailing portion, the toe wall, and the heel wall define a generally wedge shape with tangents to the walls converging at a point in front of the leading portion. If desired, the leading portion can define a leading face that circumscribes a pocket, and a strike insert can be disposed in the pocket flush with the leading face for striking a golf ball.

The body defines a centerline extending between the leading and trailing portions and the trailing portion defines a trailing end. A respective weight may be disposed in the trailing portion on each side of the centerline and can be recessed from the trailing end. Furthermore, the body may define a closed, generally wedge-shaped central top plate that joins the walls adjacent the leading surface and trailing end but that is spaced from the walls by respective cavities intermediate the leading surface and trailing end. Each cavity may if desired extend completely through the body in a top-to-sole dimension, and can have upper walls tapering inwardly from the top of the body toward the sole and lower walls tapering inwardly from the sole toward the top.

A boss may be provided on the top plate. An adjustment weight can be movably engaged with the boss for adjustment of the weight in the top-to-sole dimension by a golfer. To this end, the body can be formed with an open sole that is removably covered by a sole plate for gaining access to the weight.

In another aspect, a putter head includes a body defining a periphery having a long trailing edge and a short leading edge above a leading surface. No structure extends laterally past the leading edge in the plane of the leading edge. An insert is engaged with the body and is flush with the leading surface.

In yet another aspect, a putter head is formed with a leading surface and a trailing end that is larger in area than the leading surface. The trailing end is slightly convex. The leading surface, on the other hand, is flat and is at least partially defined by an insert.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
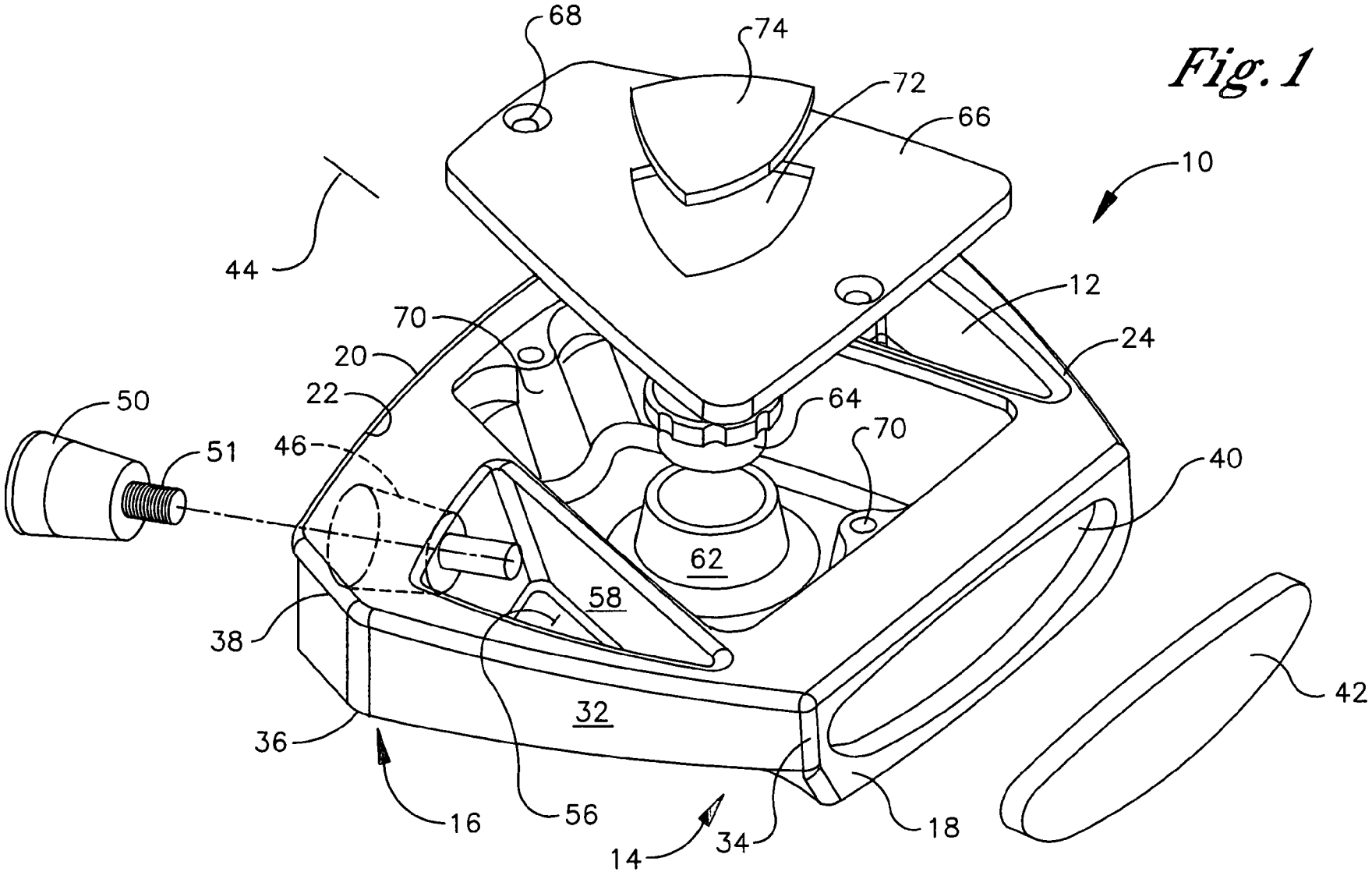
FIG. 1 is an exploded perspective view of the putter head looking at the leading face from the sole of the head.

Referring initially to FIG. 1, a golf putter head 10 includes a generally wedge-shaped unitary body 12 that has a narrower leading edge than a wider trailing edge as set forth further below.

As used herein, terms of direction/dimension are relative to the orientation the body 12 has when viewed by a golfer looking down on the head 10 while bringing the head 10 through a golf ball as intended. Thus, a "heel" part is closer to the golfer during the swing than a "toe" part; a "sole" part faces the ground during the swing and an opposed "top" part is what is seen by the golfer; and a "leading" part leads a "trailing" part through the ball during the ball striking (forward) part of the stroke.

Figure 2:
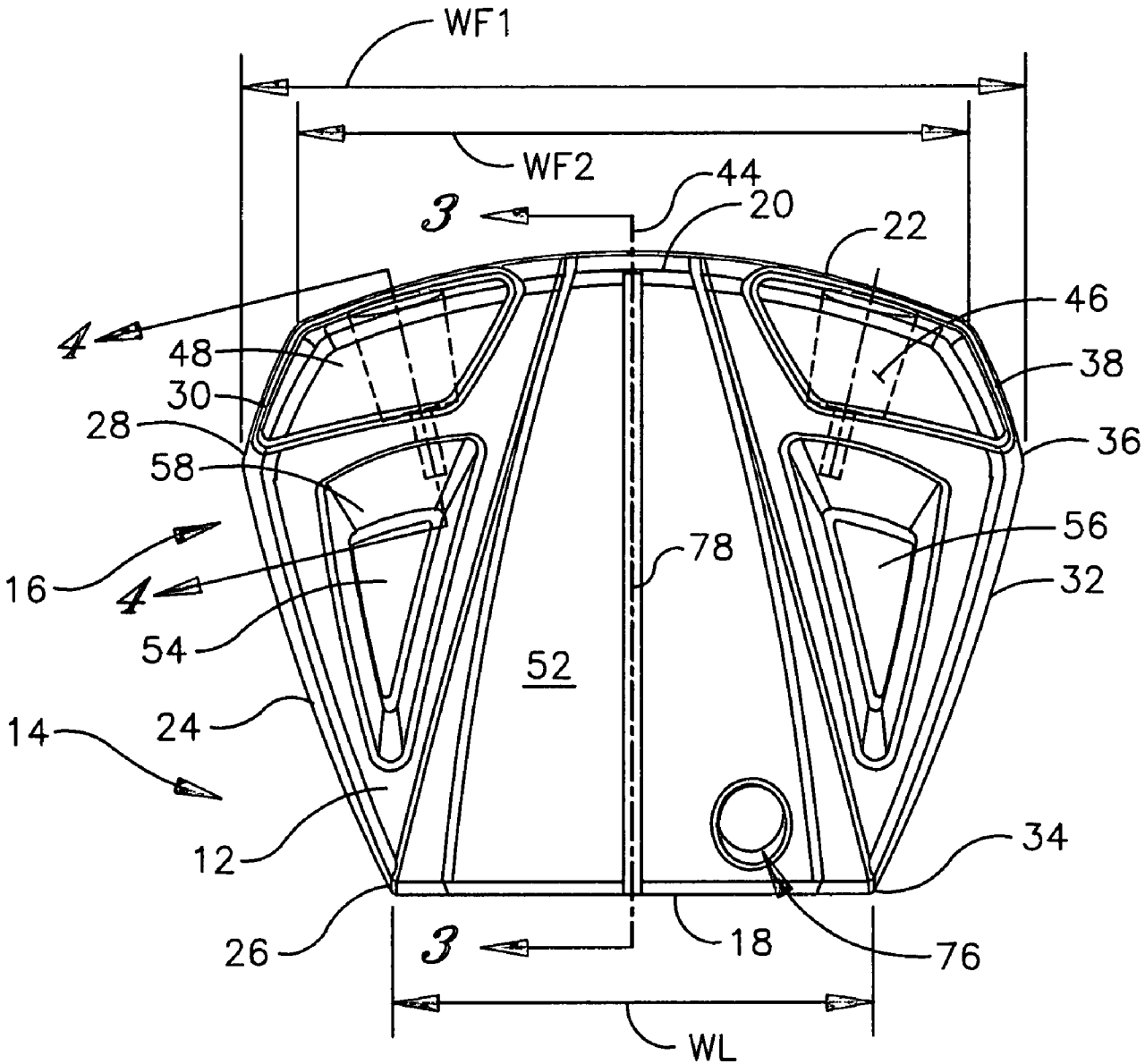
FIG. 2 is a plan view of the head looking down at the top of the head.

As shown in FIGS. 1 and 2, the body 12 defines a leading portion 14 for striking a golf ball and a trailing portion 16. The leading portion 14 defines a flat leading face 18 having a width "WL" in the heel-to-toe dimension of the head 10 that is less than the greatest width "WF1" of the trailing portion 16 and that is also less than the width "WF2" of a trailing end 20 of the trailing portion 16. In non-limiting embodiments the width "WF1" is preferably 84 mm-140 mm, more preferably 101 mm-123 mm, most preferably 106 mm-118 mm. The width "WF2" of the trailing end 20 is preferably 68 mm-113 mm, more preferably 81 mm-99 mm, most preferably 86 mm-94 mm. The width "WL" of the leading face 18 is preferably 51 mm-85 mm, more preferably 61 mm-75 mm, most preferably 65-71 mm. In a particular embodiment, WL is about 68 mm, WF1 is about 112 mm, and WF2 is about 90 mm. The face 18 can be milled if desired.

As perhaps best shown in FIG. 2, the top of the trailing end 20 of the trailing portion 16 defines a trailing edge 22. The trailing edge 22 extends substantially completely across the width "WF2" of the trailing end 20 and is straight or, as shown, gently convex, in contrast to, e.g., the discontinuous slope of the wing-shaped structure shown in U.S. Pat. No. 6,652,390. In any case, the periphery of the body 12 shown in FIG. 1 has a relatively long trailing edge 22 and a relatively shorter leading edge above the leading face 18, and there is no structure in the plane of the leading face 18 that extends laterally past the leading edge. Thus, it may readily be appreciated that the trailing end 20 is larger in area than the leading face 18.

FIGS. 1 and 2 also show that the body 12 defines a toe wall 24 that connects a toe edge 26 of the leading face 18 with a toe edge 28 of the trailing portion 16. In the non-limiting embodiment shown, the toe edge 28 may be connected to the trailing end 22 proper by a short toe side connecting wall 30 as shown that may have an opposite slope to the slope of the toe wall 24.

The body 12 also defines a heel wall 32 that connects a heel edge 34 of the leading face 18 with a heel edge 36 of the trailing portion 16. In the non-limiting embodiment shown, the heel edge 36 may be connected to the trailing end 22 proper by a short heel side connecting wall 38 as shown that may have an opposite slope to the slope of the heel wall 32.

In any case, it may be appreciated from FIGS. 1 and 2 that the trailing portion 16, the toe wall 24, and the heel wall 32 define a generally wedge shape, with tangents to the walls 24, 32 converging at a point in front of the leading face 18.

FIG. 1 best shows that the leading face is formed centrally with a pocket 40 that does not extend completely through the body 12 but instead establishes a depression into which a strike insert 42 is disposed substantially flush with the leading face 18 for striking a golf ball. The strike insert 42 is formed from any suitable combination of metal, composite, ceramic, or plastic materials that result in a pleasing and effective "feel" to a golfer when the insert 42 strikes a golf ball.

FIGS. 1 and 2 best show that the body 12 is partially hollow and defines a centerline 44 that extending between the leading and trailing portions 14, 16. On each side of the centerline 44 the trailing portion 16 is formed with respective weight holes 46, 48 that extend inwardly from the trailing end 20 and that are canted toward the centerline 44 as shown. Respective weights (only one weight 50 is shown in FIG. 1) are disposed in the weight holes 46, 48 and once advanced into their respective weight holes preferably are slightly recessed from the trailing end 20. In some implementations and as shown in FIG. 1, the weight holes 46, 48 may be internally threaded at least in part and the weight 50 may have a threaded shank 51 for engaging the threaded portion of the hole. Desirably, the weight holes can be configured substantially identically to the weights.

The weights 50 may be made of a material having a density greater than the density of the material of the body 12. The weights 50 may be made of a brass material. Alternatively and without limitation, the weights may be made of stainless steel, tungsten, silver, gold, nickel, nickel based alloys, iron based alloys, tin, copper, aluminum, and platinum. The two weights are preferably equal in weight.

Figure 3:
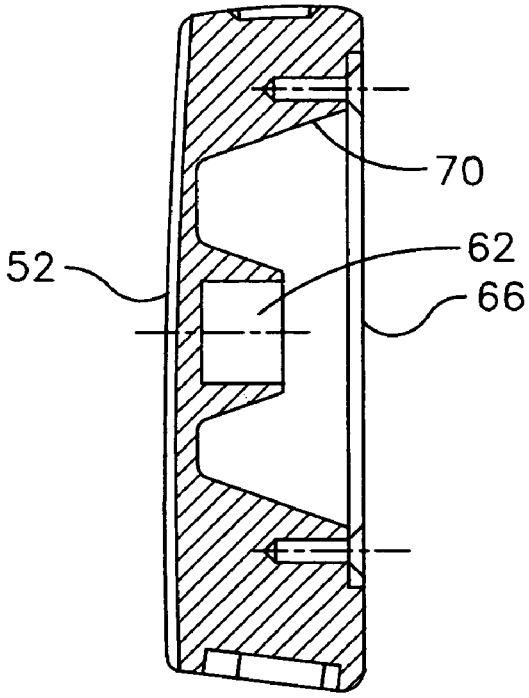
FIG. 3 is a cross-sectional view as seen along the line 3-3 in FIG. 2.
Figure 4:
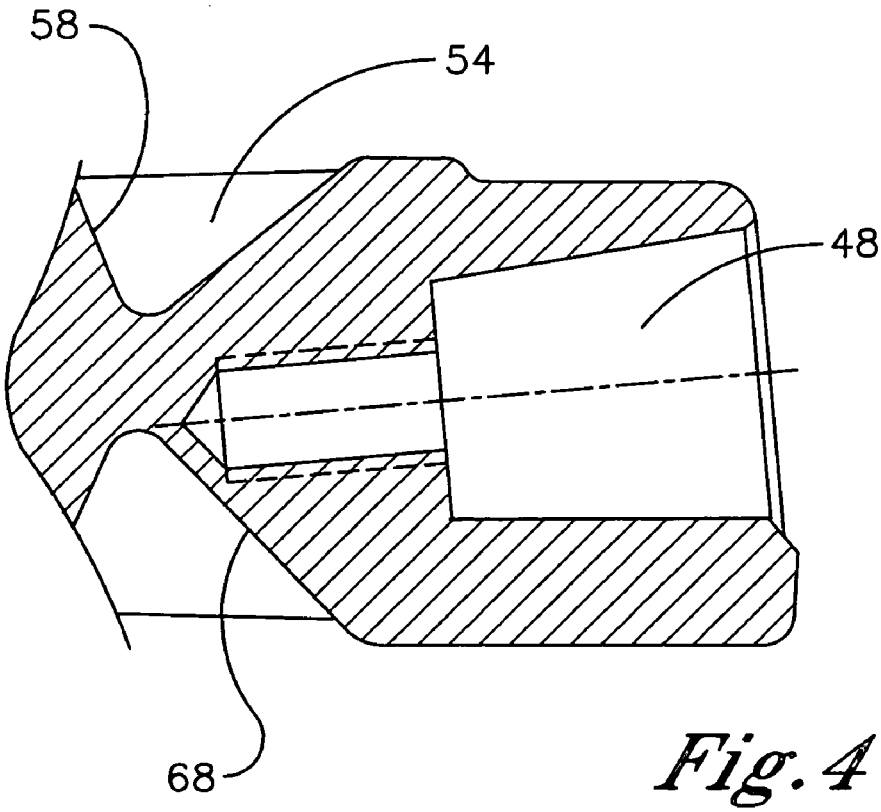
FIG. 4 is a cross-sectional view as seen along the line 4-4 in FIG. 2.

FIGS. 2 and 3 show that the body 12 defines a closed generally wedge-shaped central top plate 52 joining the walls 24, 32 adjacent the leading and trailing surfaces 18, 20 but spaced from the walls 24, 32 by respective generally triangular cavities 54, 56 intermediate the leading and trailing surfaces 18, 20. Each cavity 54, 56 extends completely through the body in the top-to-sole dimension of the head 10. In some implementations and taking the cavity 54 shown in FIGS. 1, 2, and 4 as an example, each cavity 54, 56 has upper walls 58 tapering inwardly from the top of the body 12 toward the sole and lower walls 60 tapering inwardly from the sole toward the top. Note that FIG. 4 is a cross-section taken at a location to show that the weight hole 48 does not extend into the cavity 54, and so the through-part of the cavity 54 cannot be seen in the cross-section of FIG. 4.

Cross-referencing FIGS. 1 and 3, a boss 62, preferably internally threaded, may be formed in some embodiments on the top plate 52. An adjustment weight 64 (FIG. 1) can be movably (e.g., threadably) engaged with the boss 62 for adjustment of the weight 64 in the top-to-sole dimension by a golfer. To permit this, the body 12 can be formed with an open sole that is removably covered by a sole plate 66 for gaining access to the weight 64. The sole plate 66 may be formed with opposed fastener holes 68 so that threaded fasteners (not shown) may be positioned in the holes 68 and threadably engaged with respective internally threaded boss pillars 70 formed on the centerline 44 of the body 12 in the leading and following portions 14, 16. If desired, the sole plate 66 can be formed with a recess 72 for receiving a badge 74 in a flush relationship with the sole plate 66.

In one non-limiting implementation shown in FIG. 2, the top plate 52 may be formed with a hosel hole 76 near the leading face 18 on the heel side of the head 10 for receiving a hosel (not shown) or the tip end of a putter shaft. Also, the top plate 52 can be inscribed or otherwise formed with an alignment mechanism for assisting a golfer during a putt. A non-limiting alignment mechanism can be a visible line 78 inscribed in the top surface of the top plate 52 and extending along the centerline 44 as shown.

With the above-described structure, most of the mass of the head is rearward and laterally spaced from the swing centerline axis of the body 12. The ratio of the width of the leading surface of the body 12 to the largest width of the trailing portion can be, in non-limiting implementations, 0.49 to 0.81, more preferably 0.59 to 0.72, and most preferably 0.62 to 0.68. The ratio can be 0.65. Greater than ten percent of the mass of the head (and indeed in non-limiting implementations more than thirteen percent of the mass of the head) is laterally spaced outside the heel and toe edges of the leading surface. Also, over fifty percent of the mass of the head is rearward of the geometric center of the body 12. Indeed, in non-limiting implementations nine percent of the mass of the head is both rearward of the geometric center of the body 12 and is laterally spaced outside the heel and toe edges of the leading surface, it being understood that the geometric center of the clubhead is located at about 50% of the maximum distance between the leading and trailing edges. Thus, the center of gravity, while advantageously being on the swing centerline axis, is located rearward of the geometric center of the body 12. With the structure set forth herein, the moment of inertia (MOI) about the vertical axis (i.e., in the top-to-sole dimension) through the head's center of gravity can be, e.g., greater than 400 kg-mm2, more preferably greater than 450 kg-mm2, and most preferably greater than or equal to 490 kg-mm2, while the MOI about the heel-to-toe axis through the center of gravity can be greater than 195 kg-mm2, more preferably greater than 225 kg-mm2, and most preferably greater than or equal to 250 kg-mm2, both being advantageously high moments of inertia and resulting in a high ratio between the MOI about the vertical axis and the MOI about the heel-to-toe axis of greater than 0.41, more preferably greater than 0.51, and most preferably greater than 0.60.

The center of gravity is preferably disposed at about 40-60% of the maximum distance between the leading and trailing edges, more preferably at about 45-55% of the maximum distance between the leading and trailing edges, most preferably about 49-51% of the maximum distance between the leading and trailing edges. In a particular embodiment, the center of gravity is disposed at about 50% of the maximum distance between the leading and trailing edges. In non-limiting implementations the body 12 can be made of a material having a density ranging from nine-tenths of a gram per cubic centimeter (0.90 g/cm3) to six grams per cubic centimeter (6.0 g/cm3.) The body 12 may weigh from one hundred grams to four hundred grams, more preferably from one hundred fifty grams to three hundred fifty grams, even more preferably from two hundred grams to three hundred twenty grams. In one non-limiting implementation the body 12 weighs two hundred ninety four grams.

In non-limiting implementations the body 12 may be formed from an aluminum alloy. Alternative non-limiting materials for the body 12 include steel alloys, titanium, titanium alloys, magnesium, magnesium alloys, composites (e.g., glass fiber reinforced polymers, carbon fiber reinforced polymers, metal matrix composites, ceramic matrix composites) and the like. The body 12 can be formed as a single cast structure using known casting techniques, such as centrifugal investment casting. However, those skilled in the art will recognize that alternative forming techniques such as milling, forging, stamping, or welding forged or formed pieces, and the like may be used.

While the particular GOLF PUTTER HEAD is herein shown and described in detail, it is to be understood that the subject matter which is encompassed by the present invention is limited only by the claims.

What is claimed is:

1. A golf putter head comprising:

a generally wedge shaped unitary body defining a leading portion for striking a golf ball and a trailing portion, the leading portion having a first width in a heel-to-toe dimension of the head, the trailing portion having a second width in the heel-to-toe dimension that is greater than the first width, the trailing portion including a trailing edge extending substantially completely across the second width, the trailing edge being straight or gently convex wherein the body defines a toe wall that connects a toe edge of the leading portion with a toe edge of the trailing portion and a heel wall that connects a heel edge of the leading portion with a heel edge of the trailing portion with the leading portion, the trailing portion, the toe wall, and the heel wall defining a generally wedge shape with tangents to the walls converging at a point in front of the leading portion, the leading portion defines a leading face circumscribing a pocket, a strike insert being disposed in the pocket and flush with the leading face for striking a golf ball, wherein the body defines a centerline extending between the leading and trailing portions, the trailing portion defining a trailing end, a respective weight being disposed in the trailing portion on each side of the centerline and being recessed from the trailing end, wherein the body defines a closed generally wedge-shaped central portion, a top plate joining the walls adjacent the leading face and trailing end and spaced from the walls by respective cavities intermediate the leading face and trailing end, each cavity extending completely through the body in a top-to-sole dimension.

2. The putter head of claim 1, comprising a boss on the top plate and a weight movably engaged with the boss for adjustment of the weight in the top-to-sole dimension by a golfer, the body being formed with an open sole removably covered by a sole plate for gaining access to the weight.

3. The putter head of claim 1, wherein each cavity has upper walls tapering inwardly from a top of the body toward a sole and lower walls tapering inwardly from the sole toward the top.

4. A putter head, comprising:

a body defining a periphery having a long trailing edge and a short leading edge above a leading surface, no structure extending laterally past the leading edge in the plane of the leading edge; and an insert engaged with the body and flush with the leading surface, the leading surface circumscribes a pocket, the insert being disposed in the pocket and flush with the leading face for striking a golf ball, wherein the body is generally wedge-shaped and defines a leading portion terminating in the leading surface a trailing portion bounded by the trailing edge, the leading portion having a first width in a heel-to-toe dimension of the head, the trailing portion having a second width in the heel-to-toe dimension that is greater than the first width, the trailing edge extending substantially completely across the second width, the trailing edge being straight or gently convex, the body defines a toe wall that connects a toe edge of the leading portion with a toe edge of the trailing portion and a heel wall that connects a heel edge of the leading portion with a heel edge of the trailing portion with the leading portion, the trailing portion, the toe wall, and the heel wall defining a generally wedge shape with tangents to the walls converging at a point in front of the leading portion, wherein the body defines a centerline extending between the leading and trailing portions, the trailing portion defining a trailing end, a respective weight being disposed in the trailing portion on each side of the centerline and being recessed from the trailing end, wherein the body defines a closed generally wedge-shaped central portion, a top plate joining the walls adjacent the leading surface and trailing end and spaced from the walls by respective cavities intermediate the leading surface and trailing end, each cavity extending completely through the body in a top-to-sole dimension.

5. The puffer head of claim 4, wherein each cavity has upper walls tapering inwardly from a top of the body toward a sole and lower walls tapering inwardly from the sole toward the top.

6. A putter head, comprising:

a body defining a periphery having a long trailing edge and a short leading edge above a leading surface, no structure extending laterally past the leading edge in the plane of the leading edge; and an insert engaged with the body and flush with the leading surface, the leading surface circumscribes a pocket, the insert being disposed in the pocket and flush with the leading face for striking a golf ball, wherein the body is generally wedge-shaped and defines a leading portion terminating in the leading surface a trailing portion bounded by the trailing edge, the leading portion having a first width in a heel-to-toe dimension of the head, the trailing portion having a second width in the heel-to-toe dimension that is greater than the first width, the trailing edge extending substantially completely across the second width, the trailing edge being straight or gently convex, the body defines a toe wall that connects a toe edge of the leading portion with a toe edge of the trailing portion and a heel wall that connects a heel edge of the leading portion with a heel edge of the trailing portion with the leading portion, the trailing portion, the toe wall, and the heel wall defining a generally wedge shape with tangents to the walls converging at a point in front of the leading portion, wherein the body defines a centerline extending between the leading and trailing portions, the trailing portion defining a trailing end, a respective weight being disposed in the trailing portion on each side of the centerline and being recessed from the trailing end;

a boss on a top plate and a weight movably engaged with the boss for adjustment of the weight in the top-to-sole dimension by a golfer, the body being formed with an open sole removably covered by a sole plate for gaining access to the weight.

7. A putter head formed with a leading surface and a trailing end that is larger in area than the leading surface, the trailing end being slightly convex, the leading surface being flat and being at least partially defined by an insert, wherein the head includes a unitary generally wedge-shaped body defining a leading portion terminating in the leading surface a trailing portion terminating in the trailing end, the leading portion having a first width in a heel-to-toe dimension of the head, the trailing portion having a second width in the heel-to-toe dimension that is greater than the first width, the trailing end extending substantially completely across the second width, wherein the body defines a toe wall that connects a toe edge of the leading portion with a toe edge of the trailing portion and a heel wall that connects a heel edge of the leading portion with a heel edge of the trailing portion with the leading portion, the trailing portion, the toe wall, and the heel wall defining a wedge shape with tangents to the walls converging at a point in front of the leading portion, wherein the body defines a centerline extending between the leading and trailing portions, a respective weight being disposed in the trailing portion on each side of the centerline and being recessed from the trailing end, wherein the body defines a closed generally wedge-shaped central portion, a top plate joining the walls adjacent the leading surface and trailing end and spaced from the walls by respective cavities intermediate the leading surface and trailing end, each cavity extending completely through the in a top-to-sole dimension.

* * * * *